United States Patent [19]

Montanari et al.

[11] Patent Number: 4,792,172

[45] Date of Patent: Dec. 20, 1988

[54] GRIPPING AND LIFTING CLAMP FOR PIPES AND CYLINDRICAL OBJECTS OF LARGE DIMENSIONS

[75] Inventors: Paolo Montanari, San Lazzaro; Oneglio Sala, Bologna, both of Italy

[73] Assignee: Riva Calzoni S.P.A., Via Emilia Ponente, Italy

[21] Appl. No.: 32,320

[22] Filed: Mar. 30, 1987

[30] Foreign Application Priority Data

Mar. 28, 1986 [IT] Italy ..... 19915 A/86
Mar. 20, 1987 [IT] Italy ..... 47754 A/87

[51] Int. Cl.[4] ..... E21B 19/10
[52] U.S. Cl. ..... 294/102.2
[58] Field of Search ..... 294/102.2, 102.1, 90, 294/86.12, 86.1, 87.1; 166/75.1, 77.5, 85, 313

[56] References Cited

U.S. PATENT DOCUMENTS 3,058,189 10/1962 Rechtin ..... 294/102.2
4,550,942 11/1985 Berg ..... 294/102.2

*Primary Examiner*—James B. Marbert
*Attorney, Agent, or Firm*—Herbert Dubno

[57] ABSTRACT

A gripping and lifting clamp for pipes and cylindrical objects has an annular body equipped to be suspended and lifted. Inside the annular body is a plurality of jaws slidable on guides integral with the annular body and inclined converging towards the center downwardly. The jaws are connected by connecting rods to an axially movable common ring, carried by controllable actuating members adapted to bring the ring from a raised position to a lowered position, thereby determining, via the connecting rods, sliding of the jaws in the axial direction of the annular body on the inclined guides, between a raised, widened position and a lowered, closed position, in which the jaws come into contact with and grip onto the external surface of the pipe or cylindrical object to be lifted. The angle of inclination of the guides is such as to determine, due to the friction existing between jaws and pipe, the checking and support of the pipe itself by sticking friction.

8 Claims, 3 Drawing Sheets

GRIPPING AND LIFTING CLAMP FOR PIPES AND CYLINDRICAL OBJECTS OF LARGE DIMENSIONS

FIELD OF THE INVENTION

The present invention relates to a gripping and lifting clamp for pipes and cylindrical objects with vertical axes, and is intended to permit a reliable support of the pipes or cylindrical objects by applying a limited clamping force even for pipes or objects of considerable weight.

BACKGROUND OF THE INVENTION

In numerous circumstances it is necessary to grip and raise pipes and cylindrical objects with their axes being vertically oriented, the objects being of great weight, for transporting them and locating them at the desired site.

An example of such an operation is the construction of extraction wells, in which a number of drill pipes are to be positioned in succession, or the positioning of foundation on piles and the like, as in the case of marine platforms for petroleum extraction.

In all the cases, it is essential to provide a reliable gripping of the cylindrical object, which demands the clamping of the object with high force, and checking of the descent and supporting the weight of the object by friction.

A clamp or chuck must therefore be provided, which is equipped with means for developing such clamping force and which shall be capable, for its part, of being lifted and transported according to the requirements of the envisaged use.

In particular, in the case of marine platforms, it is necessary to position foundation piles or tubes of great length. In this case in many common applications, a number of segments of tubes having a maximum convenient length, which nevertheless is insufficient for forming a foundation pile in one single piece, must be connected together on the jobsite by welding or by the use of joints of other types, which are not always perfect, with complex operations in order to obtain the piles of the complete length required.

To overcome these problems it is possible to prepare in the contractor's yard the piles of the required length, by joining together a plurality of tube segments, the joining being carried out by welding or other means, under appropriate conditions, and then transporting the already prepared piles to their location zone on the platform and positioning them in their seat.

For this procedure, however, gripping devices are required that are capable of raising and supporting tubular objects of extremely large dimensions and high weights, causing very high mechanical loadings in the lifting devices, where moreover the tubular objects may possess geometrical irregularities, such as an oval configuration or the like, which may render gripping them difficult.

OBJECT OF THE INVENTION

It is an object of the invention to provide an improved gripping clamp or chuck, which can develop the required clamping force without having resort to high-powered equipment, which is capable of rapid operation in gripping and releasing the pipe or cylindrical object, and which is of robust construction with the operating members located in a protected position, adapted and gripping for lifting even cylindrical objects of large dimensions and firmly supporting them during positioning on the job.

SUMMARY OF THE INVENTION

This object is obtained, by the present invention, which provides a gripping and lifting clamp for pipes and cylindrical objects, which comprises an annular body, equipped with suspension means for raising it, carrying in its interior a plurality of jaws slidable on guides integral with (affixed to) the annular body and inclined converging towards the center and downwardly, which jaws are connected, by connecting rods, to an axially movable common ring, carried by controllable operating members adapted for bringing the ring from a raised position to a lowered position, thereby effecting, via the connecting rods, a sliding of the jaws in the direction of the axis of the annular body on the inclined guides, between a raised, widened position and a lowered, closed position, in which the jaws come into contact with and clamp onto the external surface of the pipe or tube or cylindrical object to be lifted, the angle of slope of the guides being such as to effect, by reason of the friction existing between jaws and pipe, the checking of the downward movement and supporting of the pipe by sticking friction.

According to an embodiment of the gripping and lifting clamp for pipes or cylindrical objects according to this invention, the axially movable common ring is located inside the annular body and carries the connecting rods linked to the jaws, in between which there are disposed, along the internal perimeter of the annular body, the controllable operating members, in a position protected from impact and the like.

In this embodiment, there are disposed, between the jaws and the controllable operating members, radial centering plates for the centered location of the pipes or cylindrical objects to be lifted.

In an alternative embodiment of the gripping and lifting clamp for pipes and cylindrical objects according to the present invention, the axially movable internal ring is situated externally of the annular body, the controllable operating members being connected directly to it and disposed along the external perimeter of the annular body. A plurality of brackets, extending inwardly are provided on the mobile ring and pass through vertical slots formed opposite to them in the cylindrical wall of the annular body, to which brackets there are connected the connecting rods articulated to the jaws slidable inside the annular body.

The controllable operating members may advantageously be double-acting fluid-operated cylinders.

In the case where it may be necessary to grip and raise pipes or objects possessing an oval form, the axially movable common ring may be formed in a number of separate segments, each of which is connected to at least one actuating cylinder and at least one jaw, the gripping travel movements of the actuating cylinders and the jaws being independent and able to be different from one another, thus guaranteeing gripping with all the jaws or at least with a majority of them.

The front surface of the jaws, intended for making contact with the surface of the pipe or cylindrical object to be lifted, is formed with gripping projections adapted to increase the friction developed against the surface.

The gripping projections with advantage are provided on shoes, in one or more vertical rows. The shoes can be received in undercut seats in the surface of the jaws facing towards the pipe or cylindrical object to be gripped, transmitting by friction to the jaws the load resulting from the suspension of the pipe.

The gripping projections in one row are with advantage combined into one or more superimposed groups inside undercut seats, separated from one another by crossbars fixed to the jaw and adapted for holding a vertical load transmitted to them by the gripping knobs.

The crossbars are seated in transverse recesses of the face of the jaw towards the pipe or cylindrical object to be gripped, suitable for withstanding the forces transmitted by the crossbars, the crossbars being locked in the recesses by releasable means such as screws or the like.

The parts of the jaws subjected to sliding wear or the like are formed as separate components, e.g. the above-mentioned shoes, connected to the other parts of the structure by rigid but releasable locking means, such as screws or the like.

The parts of the jaws subjected to wear comprise, among others, the sliding seats of the jaws on the inclined guides, the sliding members for locking the jaws to the guides, the gripping projections and the associated crossbars.

The jaws are with advantage formed in two parts, releasably connected together, the one slidable on the relevant guide and the other facing towards the cylindrical object to be supported and equipped with the gripping projections, it being possible for a calibrated shim, adapted for permitting the effective gripping diameter of the jaws themselves to be varied, to be placed and locked between the two parts.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 3:
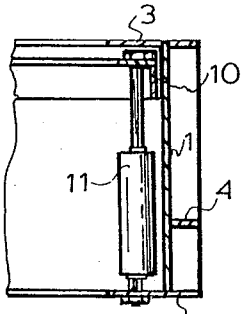
FIG. 3 is a detail in section taken along the line III—III of FIG. 2.
Figure 1:
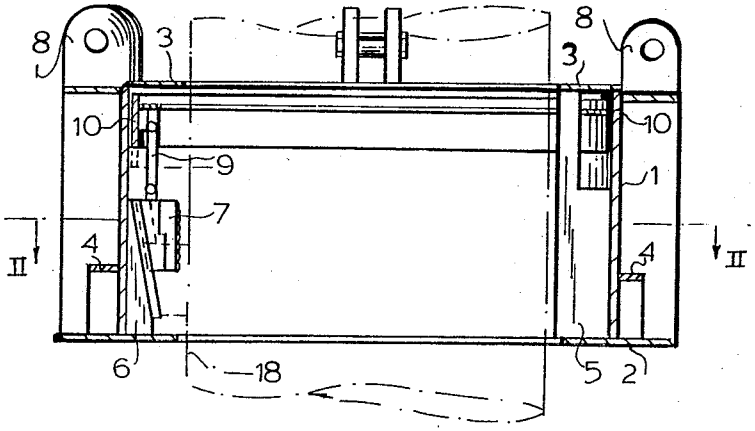
FIG. 1 is an axial section through a lifting clamp according to this invention taken along the line I—I of FIG. 2.
Figure 2:
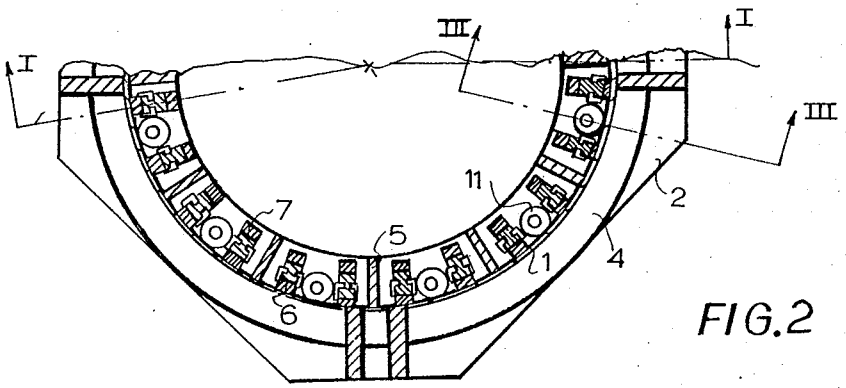
FIG. 2 is a section taken along the line II—II of FIG. 1.

As shown in FIGS. 1 to 3, the clamp for lifting pipes according to this invention comprises an annular body 1, equipped with lower and upper flanges 2, 3 and with reinforcing rings 4. Within the annular body there are disposed a plurality of radial centering plates 5 and a plurality of inclined guides 6, carrying the clamping jaws 7.

The body 1 carries, externally, the suspension means in the form of lifting lugs 8, by which the clamp is connected to the lifting and placing members for the pipe to be gripped by it.

The jaws 7 are connected, by means of the connecting rods 9, to a common ring 10, movable in the axial direction. To this ring there are connected, by their movable rods, a plurality of cylinders 11, secured at the opposite end to the base flange 2 of the body 1.

As will be seen from FIG. 2, the cylinders 11 are advantageously located between the jaws 7, and the plates 5 are disposed alternately between them the jaws 7 as well, alternating with the cylinders 11.

This arrangement permits the cylinders 11 to be placed in a position shielded from impacts against external members during the movement of the clamp, while the jaws 7 and the plates 5 protect the cylinders from accidental contact with the pipe or cylindrical object to be lifted, located inside the clamp.

Figure 4:
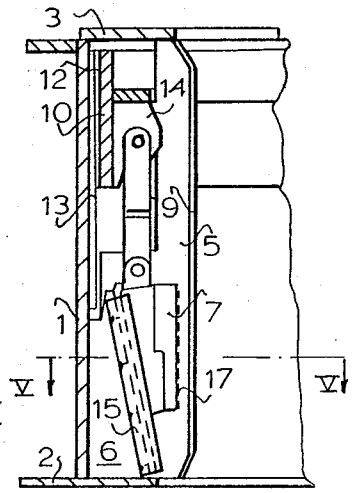
FIG. 4 is an enlarged detail section of the clamp of FIG. 1.

In greater detail, as illustrated in FIG. 4, the ring 10 is equipped with slide skids 12, fixed to it, and slidable on the fixed guide 13 secured to the body 1.

The ring 10 carries the brackets 14 for the attachment of the connecting rods 9, which are articulated to the jaws 7.

Figure 5:
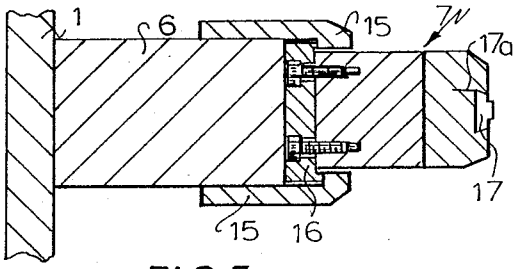
FIG. 5 is a section taken along the line V—V of FIG. 4.

The inclined guides 6, as shown in FIGS. 4 and 5, are equipped with lateral restraining cheeks 15, between which the sliding portion 16 of the jaw 7 is retained.

This sliding portion 16 may, as illustrated in the example of embodiment, be composed of a separate body, attached by screws or the like to the body of the jaw; in this case, it may be made from a different material from the body of the jaw itself, such as for example a low-friction metal alloy.

On the face of the jaw there are advantageously disposed one or more rows of gripping knobs or projections 17, adapted for achieving high friction against the surface of the pipe.

The gripping knobs 17 are, in the form illustrated in FIGS. 4 and 5, inserted into an undercut recess 17*a* of the jaw. In the act of radial gripping of the jaws against the pipe, the frictional force developed between the knobs and the surface of the pipe guarantees suspension without slipping of the pipe, while the corresponding frictional force existing between the knobs and the surface of the recess in the jaw behind them prevents slip between the knobs and the remainder of the jaw, thereby ensuring a rigid connection between the gripping knobs and the jaw without members which lock the knobs themselves to the jaws in the vertical direction, and which are designed to prevent them from escaping from the bottom of the recess 17*a*, being required to resist the high loading occurring.

As FIG. 1 shows, the gripping of a pipe takes place by the lowering, via the cylinders 11, of the ring 10 and the jaws connected to it, until they are brought into contact with the external surface of a pipe 18, gripping onto it, as shown in FIG. 1 by dot-and-dash lines. The friction exerted in such circumstances, between the jaws and the pipe, has the effect that the weight of the pipe itself causes a further lowering of the jaws and an increased gripping force on the pipe, thereby affecting its suspension by sticking action, and even by exerting a limited force through the cylinders 11, sufficient for creating an initial gripping of the pipe, for example when it is in a horizontal position before being placed in its final position, which permits the initial lifting of the pipe, generating a friction between pipe and jaws which, during the progressive raising of the pipe, causes further downward sliding of the jaws on the inclined guides, thereby producing a progressive increase in the gripping force until the value sufficient for permitting the suspension of the entire pipe is reached.

Figure 6:
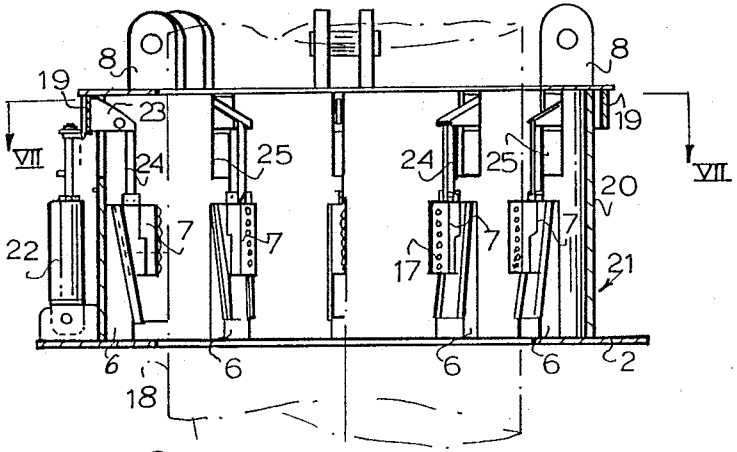
FIG. 6 is an axial section of the gripping and lifting clamp according to this invention in another embodiment taken along line VI—VI of FIG. 7.
Figure 7:
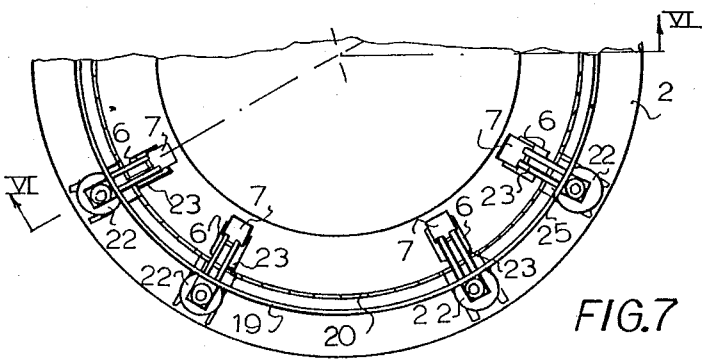
FIG. 7 is a section taken along line VII—VII of FIG. 6.

In FIGS. 6, 7, an alternative embodiment of the invention is illustrated, in which the ring 19 is disposed outside the cylindrical wall 20 of the body 21.

The ring 19 is equipped with actuating cylinders 22, disposed externally of the body 21, and it is connected by brackets 23 to the connecting rods 24, which actuate the jaws 7 located inside the body 21. The jaws may have a structure analogous to that illustrated in the preceding case, and are therefore given the same reference numbers.

To permit the brackets 23 to pass into the interior of the body 21, its cylindrical wall 20 is equipped, opposite each bracket and therefore each jaw 7, with slits 25 communicating with the interior.

The functioning of the clamp in the second embodiment is in every way analogous to that described above.

In this embodiment, the actuating cylinders are located outside the annular body 21, and are therefore protected, by the annular body 21 itself, from possible impact from the pipe inside during clamping, as well as being more accessible for adjustment or maintenance operations.

Figure 9:
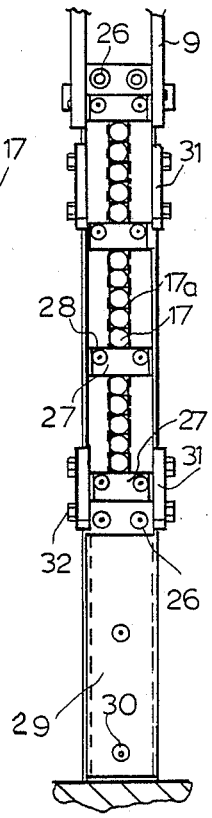
FIG. 9 is a front view of the jaw of FIG. 8.
Figure 8:
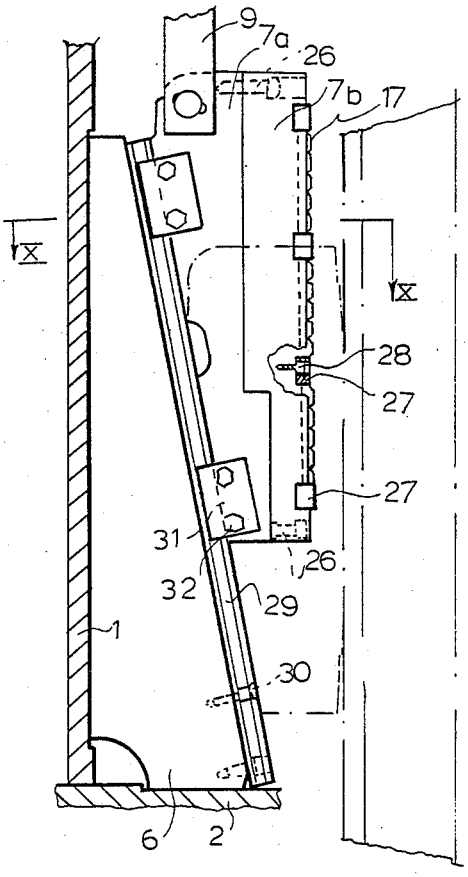
FIG. 8 is a partial section showing the jaw according to this invention drawn to a larger scale and in a lateral view.
Figure 10:
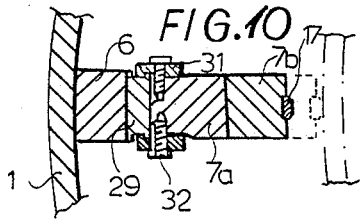
FIG. 10 is a section taken along the line X—X of FIG. 8.

The gripping jaw for either embodiment is illustrated in detail in one preferred form in FIGS. 8 to 10. The jaw comprises a posterior part *7a*, linked to the connecting rods 9, and of an anterior part or shoe *7b*, attached to the part *7a* by screws 26 and carrying the gripping knobs 17, inserted in the associated groove *17a*.

In some phases of the gripping of the pipe by the clamp it may be found that the friction developed by the knobs 17 against the surface of the pipe is greater than the friction developed by the rear face of the knobs against the base of the groove *17a*. This could lead to sliding of the knobs themselves inside the groove, bringing the entire load applied to the jaw onto a lower retaining member for the knob themselves.

With the objective of preventing this situation, for which a lower retaining member for the knobs could not be made of sufficiently large size, there are provided, in the form of embodiment shown in FIG. 8, a number of crossbars 27, inserted in corresponding recesses of the front face of the jaw 7 and held in position by associated screws 28, which divide the column of knobs 17 into a number of bays, three as can be seen in FIGS. 8 and 9, each comprising a limited number of knobs, so as to be supported by the associated crossbar 27 situated below a supportable load, in the case of low friction between the rear face of the knobs and the base of the groove *17a*.

The installation of the crossbars 27 in associated recesses furthermore enables the forces due to the load to be transmitted directly to the walls of the recesses themselves, without the screws 28 being required to do this.

The jaws can be constructed, as illustrated in FIG. 5, with a sliding part 16, connected to them by screws, held in contact with the inclined guide 6, by lateral containing cheeks 15. In the embodiment illustrated in FIGS. 8 and 10, a skid plate 29 is attached by screws 30 to the inclined guide 6 and equipped with lateral grooves into which the corresponding projecting parts of the containing cheeks 31 can be inserted, these cheeks being constructed in two pairs of limited length for each flank and attached to the jaw 7 by appropriate screws 32.

Both the jaw of FIGS. 4 and 5 and that of FIGS. 8 and 10 permit the parts subjected to wear, or accidentally damaged, to be replaced. This allows the components constituting the jaw to be of a size which obtains maximum benefit from the characteristics of the material used, periodic maintenance being possible with easy replacement of any worn parts, executed quickly even on the job, without necessitating machining or welding operations.

Figure 11:
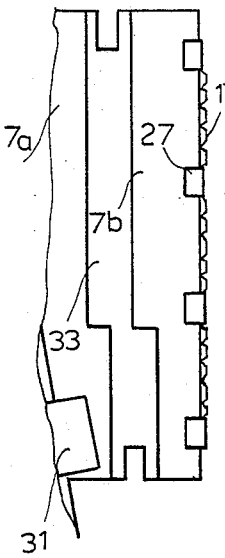
FIG. 11 is a side view of the jaw of FIG. 8, mounted with a spacer.

In FIG. 11 there is shown a further possibility offered by the jaws of the clamp according to this invention: for the purpose of providing the possibility of operating with the clamp even on pipes or piles of widely varying diameters, and in particular less than that normally envisaged, it is in fact possible to provide, between the anterior part *7b* and the posterior part *7a* of the jaw, a spacer 33, of calibrated thickness, which brings the knobs 17 into action at a differing gripping diameter.

In the case where oval deformation of the pipe or cylindrical object to be lifted may have occurred; which could lead to contact of only a limited number of jaws with its surface, in positions corresponding to the greater diameter of the pipe, thereby applying to these jaws the entire load, it is possible, in order to obtain clamping of the pipe by all the jaws available, thereby distributing the weight lifted over all of them, to construct the ring carrying the connecting rods in a plurality of successive segments, each of them equipped with at least one connecting rod and one actuator cylinder, so as to make the movements of the jaws, or groups of jaws, independent of one another, thereby bringing all the jaws, or at least the majority of them into contact with the surface of the pipe to be gripped.

We claim:

1. A gripping and lifting clamp for a cylindrical object, comprising:

an annular body adapted to surround an object to be gripped and lifted;

means forming a plurality of guides spaced apart around an inner wall of said body and inclined downwardly and inwardly thereon;

respective jaws slidable along said guides and each including:

a member having a side turned toward said object and formed with a vertically extending undercut groove opening toward said object, and a side turned toward the respective guide and inclined downwardly and inwardly to slide along said guide, a vertical row of gripping projections slidably received in said groove and individually engageable with said object, said projections being provided in a plurality of groups, and respective crossbars affixed to said member below each group to said gripping projections for supporting same against downward movement upon engagement with said object and lifting to said body;

suspending means on said body for enabling the raising and lowering thereof;

a ring moveable on said body upwardly and downwardly;

respective links articulated to said jaws and connected to said ring for displacement of said jaws by said ring; and controllable actuating members on said body acting upon said ring for displacing same to retract said jaws from said object and to displace said jaws into engagement with said object whereby said gripping projections engage said object and take up weight of the object.

2. The gripping and lifting clamp defined in claim 1 wherein said actuating members are cylinders spaced around the interior of said body between said jaws and the respective guides, said body being formed with centering plates projecting radially inwardly beyond said cylinders between pairs of said guides alternatingly with said cylinders.

3. The gripping and lifting clamp defined in claim 1 wherein said ring is disposed externally of said body and said actuating members are cylinders disposed of said body, said ring being formed with inwardly extending brackets articulated to said links and projecting through respective slots formed in said body into the interior of said body.

4. The gripping and lifting clamp defined in claim 1 wherein said ring is constituted from a plurality of segments moveable independently of one another and each of which is provided with a respective actuating member and at least one of said jaws.

5. The gripping and lifting clamp defined in claim 1 wherein said cross bars are seated in transverse recess on the side of each jaw turned toward said object and adapted to support forces transmitted to the respective member by the respective cross bar, said cross bars being retained in the respective recesses and respective releasable elements.

6. The gripping and lifting clamp defined in claim 1 wherein each of said members on said side turned toward the respective guide is lined with an element subject to wear and detachably connected to the respective member.

7. The gripping and lifting clamp defined in claim 1 wherein said guides are each formed on a side turned toward the respective jaw where the member is detachable therefrom and subject to wear.

8. The gripping and lifting clamp defined in claim 1 wherein each of said members is formed of parts detachably connected together and separated by a replaceable shim of a selected technique establishing the diameter of an object to be clamped.

* * * * *